United States Patent [19]

Ormsby

[11] 4,296,822

[45] Oct. 27, 1981

[54] MULTIPURPOSE FLUID FLOW ASSISTED DOWNHOLE TOOL

[75] Inventor: Ronald D. Ormsby, Woodlands, Tex.

[73] Assignee: Omega Tools International, Houston, Tex.

[21] Appl. No.: 97,496

[22] Filed: Nov. 26, 1979

[51] Int. Cl.[3] ..... E21B 25/12

[52] U.S. Cl. ..... 175/249; 175/255; 175/328; 175/237; 175/403

[58] Field of Search ..... 175/234, 240, 237, 242, 175/243, 328, 249, 255; 166/65 M, 99, 202; 294/86.32

[56] References Cited

U.S. PATENT DOCUMENTS

| | | | |
|---|---|---|---|
| 2,132,014 | 10/1938 | Catland | 175/255 X |
| 2,887,347 | 5/1959 | Losey | 166/202 X |
| 2,915,127 | 12/1959 | Abendroth | 166/99 |
| 3,023,810 | 3/1962 | Anderson | 175/237 X |
| 3,874,465 | 4/1975 | Young et al. | 175/243 X |
| 4,059,155 | 11/1977 | Greer | 175/237 X |

OTHER PUBLICATIONS

K & G Oil Tool and Service Company, Inc. Catalog 54.

*Primary Examiner*—Ernest R. Purser

*Attorney, Agent, or Firm*—Guy E. Matthews

[57] ABSTRACT

A multipurpose fluid flow assisted downhole tool that is adapted for attachment to the lower end of a pipe string to be extended into a well bore and which is capable of cutting sample cores from subsurface earth formations and removing the cores for evaluation. The tool is also capable of removing ferrous metal objects from the bottom of the well bore by both mechanical and magnetic means in conjunction with object movement assistance that is provided by flowing fluid in the vicinity of the bottom of the well bore. The well servicing tool includes an internal mechanism that has the capability of achieving reverse circulation of fluid in the vicinity of the bottom of the well bore which causes fluid flow from the annulus between the tool and the well bore, upwardly into an internal object collection chamber defined by the well tool and then outwardly of the well tool and upwardly through the annulus between the pipe string and the well bore to the surface. Ferrous objects are attracted by a magnet movably disposed within the object collection chamber and nonferrous objects are transported into the object collection chamber by flowing fluid and are retained therein by a plurality of object retainer fingers defining the bottom portion of the object collection chamber.

21 Claims, 9 Drawing Figures

MULTIPURPOSE FLUID FLOW ASSISTED DOWNHOLE TOOL

FIELD OF THE INVENTION

This invention relates generally to servicing activities in deep wells such as petroleum producing wells, and more particularly relates to a multipurpose well servicing tool for utilization in such wells wherein the tool is adapted to provide a plurality of well servicing activities including sample core drilling and removal, and removal of objects from the bottom of the well bore, including both magnetic and nonmagnetic objects.

BACKGROUND OF THE INVENTION

During drilling operations for deep wells capable of producing petroleum products, it is particularly desirable when drilling in or near various production formations, to remove a sample core from the formation for testing at the surface. It is desirable to provide a simple and efficient well service tool having the capability of cutting a sample core from the formation. From the standpoint of efficiency and cost effectiveness it is also desirable that the well service tool also be capable of performing other service operations as well.

During well drilling operations, it is possible for various objects to fall into a well bore and, in many cases, drilling bits and well service tools deteriorate to the point that various parts thereof separate from the primary apparatus and fall to the bottom of the well. The metal objects, which are typically referred to in the industry as "junk" and "fish," must be removed from the bottom of the well before drilling operations may continue. Junk or fish typically take the form of such metal objects as rock bit cones, tail chains, hammer heads, slips, bearings, junk mill debris and the like. Junk is typically in the form of ferrous metal objects, but may also include nonferrous metal objects and nonmetal objects. In each case, it is necessary to remove the junk from the well bore in order to continue drilling operations. It is desirable to provide a well service tool having the capability of removing metal objects of both ferrous and nonferrous character from the bottom of the well bore when such activity is desired.

During well cleaning operations, which are typically accomplished by washing, it is frequently desirable at the same time to obtain a geological sample core. In the ordinary circumstance, sample cores are obtained by running a core barrel, which is an elongated hollow barrel structure having a reamer or core shoe at the lower end. As the barrel is rotated, the reamer makes a circular cut through the formation about a sample core that is received inside of the barrel and is retracted as the core barrel is removed from the well. Ordinarily, it is not possible to conduct washing operations at the same time core samples are taken. It is desirable, therefore, to provide a well service tool having the capability of accomplishing washing operations and simultaneously obtaining a sample core from the formation involved.

In many cases, small ferrous and nonferrous objects are difficult to retrieve from the bottom of a well bore. It is desirable to provide an object removal system that positively ensures removal of small objects that are ordinarily difficult to retrieve.

In view of the foregoing, it is a primary feature of this invention to provide a novel multipurpose well tool having the capability of removing junk from the bottom of a well bore regardless of the characteristics thereof.

It is also a feature of this invention to provide a novel multipurpose well tool having the capability of removing both ferrous and nonferrous metal objects such as junk from the bottom of the well bore and to ensure positive retrieval of small objects.

It is also an important consideration of this invention to provide a novel multipurpose well tool having the capability of employing circulating liquid medium for transporting metal and nonmetal objects into an appropriate receptacle for efficient extraction of the same from a well bore.

It is an even further feature of this invention to provide a novel multipurpose well service tool having the capability of simultaneously cutting a sample core from the formation involved simultaneously with removal of junk from the bottom of the well bore.

It is also a feature of this invention to provide a novel velocity barrel having the capability of reversing the directional flow of washing fluid, thereby enabling the washing fluid to transport junk from the bottom of the well bore into a junk receptacle for removal from the well bore.

Other and further objects, advantages and features of this invention will become obvious to one skilled in the art upon an understanding of the illustrative embodiment about to be described and various advantages, not referred to herein, will occur to one skilled in the art upon employment of the invention in practice.

SUMMARY OF THE INVENTION

A multipurpose liquid, flow-assisted downhole tool for removing metal objects, formation cores and other objects from the bottom of deep wells includes a connection sub for connecting the tool to the lower end of a string of drill pipe to be extended into a well. A generally cylindrical housing is interconnected with the connection sub and includes an outer barrel having a core shoe provided at the lower extremity thereof. An inner housing is retained within the outer housing and cooperates with the outer housing to define a fluid passage in the form of an annulus between the inner and outer barrels. The outer barrel is formed near the lower extremity thereof to define a plurality of downwardly and outwardly inclined velocity jets that are in communication with the annulus passage and serve to direct the flow of washing fluid downwardly and outwardly toward the well bore or casing. A plurality of centralizers are interconnected with the inner and outer barrels and a plurality of annulus ports extend through the inner and outer housings and through the centralizers, thereby providing flow passages from an inner object collection chamber defined by the inner housing, to the well bore or casing exteriorly of the outer barrel. The annulus ports are each inclined in upwardly and outwardly directed manner to allow fluid flow from the object collection chamber to the exterior of the barrel. A velocity sleeve is interconnected between the connection sub and the upper portion of the inner barrel and is formed to define a plurality of venturi ports that extend downwardly and outwardly and direct washing fluid toward the annulus between the inner and outer barrels. At the lower extremity of the velocity sleeve is defined a circular valve seat against which is seated a free-sphere type valve element that is capable of blocking fluid flow into the upper portion of the inner chamber and thereby resulting in selective accomplishment of a liquid flow reversing operation, when such is desired.

Within the well servicing tool is provided a plurality of flexible object retainer finger elements that radiate inwardly from the outer wall of the housing structure and are inclined slightly upwardly. The resilient fingers are flexible so as to allow passage of objects therepast and into an object collection chamber defined within the inner barrel. The resilient fingers are sufficiently resistant to downward bending that the weight of objects bearing upon the upper surface portions of the resilient fingers is effectively resisted. The weight of the objects tends to force the resilient fingers together causing the fingers to form a consolidated barrier that resists passage of the objects from the object collection chamber back to the bottom of the well bore.

A floating magnet is positioned within the object collection chamber and is enabled to move linearly by a considerable distance defined by the length of the chamber. As ferrous metal objects enter the object collection chamber, such objects are attracted by the magnet and are thereby magnetically retained within the inner chamber for removal from the well bore along with the velocity barrel.

The multipurpose well service tool also includes a core catcher structure that is movably positioned above the core shoe. As a core enters the object collection chamber during core reaming operations, the magnet is moved upwardly within the limits defined by the length of the inner object collection chamber. After the core has been cut, the tool is moved upwardly and the core catcher is cammed into tight gripping relationship with the core sample and applies sufficient retention force thereto that the integral relationship of the core with the formation will be broken and thus the core sample is retained within the object collection chamber for transportation to the surface. For removal of small objects such as bearings that are difficult to wash into the object collection chamber and retain for extraction, the tool may be rotated to cut a core, with the core forcing the object into the object collection chamber. With the core retained inside the object collection chamber and also retaining the small junk object therein, the object may be positively removed from the well bore with the core.

BRIEF DESCRIPTION OF THE DRAWINGS

In order that the manner in which the above-recited advantages and features of the invention are attained and can be understood in detail, more particular description of the invention, briefly summarized above, may be had by reference to the specific embodiment thereof that is illustrated in the appended drawings, which drawings form a part of this specification. It is to be understood, however, that the appended drawings illustrate only a typical embodiment of this invention and therefore are not to be considered limiting of its scope, for the invention may admit to other equally effective embodiments.

DETAILED DESCRIPTION OF PREFERRED EMBODIMENT

Figure 1:
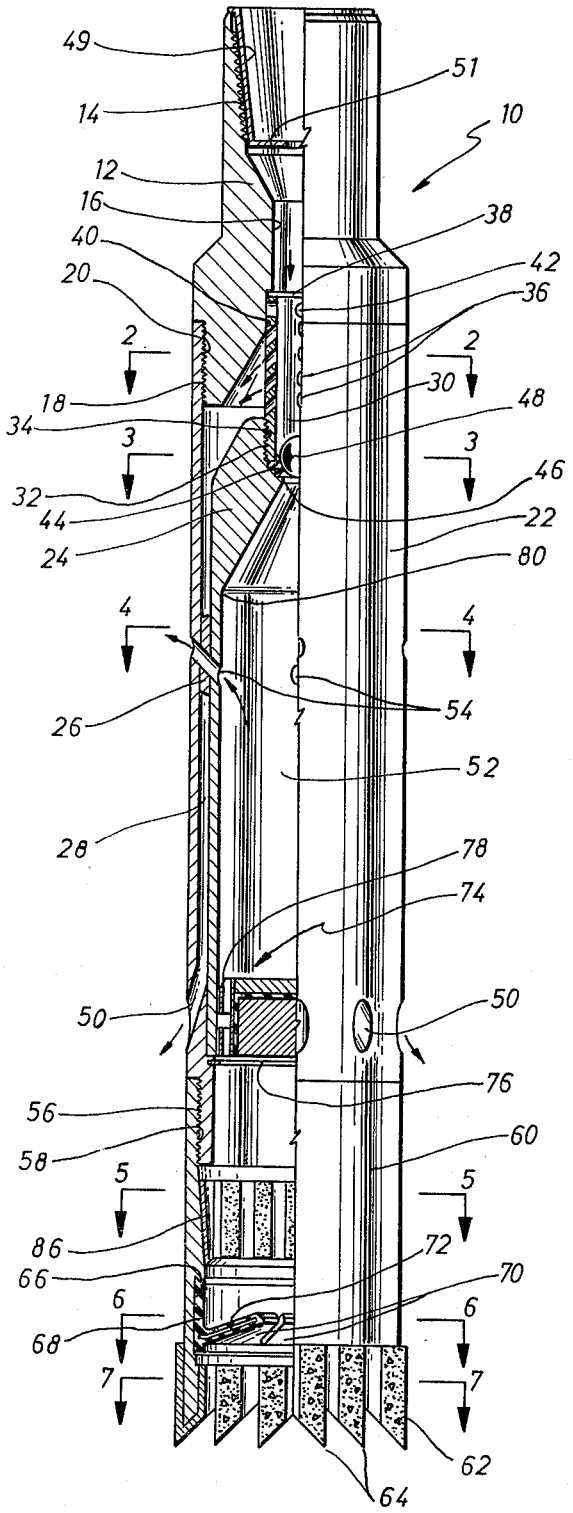
FIG. 1 is a sectional view of a multipurpose well service tool constructed in accordance with the present invention.
Figure 2:
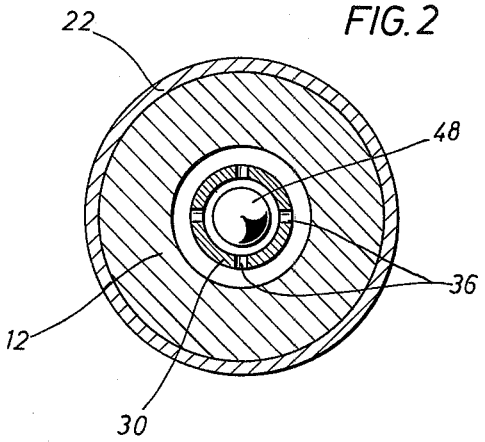
FIG. 2 is a transverse sectional view of the well service tool taken along line 2—2 of FIG. 1.
Figure 3:
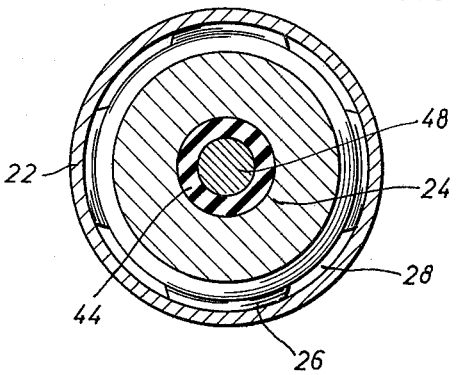
FIG. 3 is a sectional view illustrating the fluid reversing valve portion of the well service tool of FIG. 1, taken along line 3—3 of FIG. 1.
Figure 4:
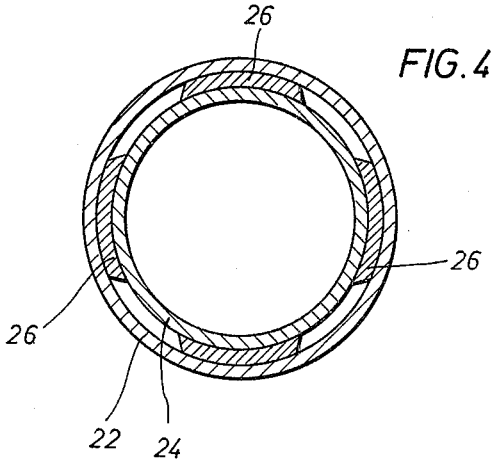
FIG. 4 is a transverse sectional view taken along line 4—4 of FIG. 1 and illustrating the relationship of the centralizers to the inner and outer barrels of the well service tool.

Referring now to the drawings and first to FIG. 1, there is shown a multipurpose well service tool generally at 10 having a connection sub 12 at the upper extremity thereof, with the connection sub being formed at the upper extremity thereof to define a "box" 14 which is internally threaded and defines a standard drill pipe connection, allowing connection of the sub to the lower threaded extremity of standard drill pipe. The connection sub 12 is also formed to define an internal flow passage 16 through which washing fluid flows from the drill stem to which the well service tool is connected. The connection sub also defines a lower externally threaded extremity 18 that is adapted to receive the internally threaded upper portion 20 of an outer barrel 22 of generally cylindrical configuration.

An inner barrel 24 is positioned within the outer barrel 22 and is maintained in spaced relation therewith by a plurality of centralizers 26 that are welded both to the inner and outer barrel structures. The inner barrel cooperates with the outer barrel structure to define an annulus 28 through which liquid is allowed to flow during reversed liquid flow as indicated hereinbelow.

During recovery of various objects from the bottom of the well bore, it is appropriate to utilize washing liquid as a vehicle to transport the objects into an object receiving receptacle and it is desirable to reverse the flow of liquid at the bottom of the well bore to allow flow of liquid from the outside of the tool into the bottom portion of the tool so that objects will be transported into the tool for retention within the object collection chamber. To accomplish flow reversal in this manner, the multipurpose well service tool 10 is provided with an internal velocity sleeve 30 that is formed to define an externally threaded lower extremity 32 that is received by an internally threaded upper portion 34 of the inner barrel 24. The velocity sleeve 30 is formed to define a plurality of downwardly and outwardly inclined venturi apertures 36 that direct flowing washing liquid downwardly and outwardly as shown by the flow arrows. The velocity sleeve 30 is of generally cylindrical form with the upper extremity 38 thereof being received within an annular recess 40 formed in the lower portion of the connector sub 12. A plurality of breakout holes 42 are formed in the upper portion of the velocity sleeve 30, thereby allowing an elongated object to be inserted through the breakout holes and utilized as a wrench for threading or unthreading the sleeve 30 within its threaded receptacle 34.

In order to provide for conventional washing operations during well completion and workover, it is necessary that there be provided a passage extending downwardly through the tool through which washing liquid may flow under sufficient velocity to accomplish cleaning of the well. The velocity sleeve 30, therefore, is formed at the lower extremity thereof to define a circular opening and an annular seat member 44 is positioned at the lower extremity of the velocity sleeve. The seat member 44 bears against an annular shoulder 46 and the lower extremity of the velocity sleeve 30 functions to bear upon the seat member and retain the seat in firm engagement against the annular support shoulder 46. In order to provide a valving function, a spherical valve element 48 is provided which is of sufficiently small diameter to pass through the drill string and through the flow passage 16 of the connector sub 12 and is of sufficiently large diameter to become seated against the annular seat member 44 to prevent further downward flow of washing fluid through the inner barrel structure. The spherical valve element 48 is simply pumped into place by washing fluid being pumped downwardly through the drill string or, in reverse manner, is pumped upwardly through the tubing string to the surface in order to return the multipurpose tool to its washing condition of centralized flow. In order to maintain the spherical valve element in assembly with the multipurpose well service tool during shipment and handling, a thread protector 49 is provided having a transverse wall 51 that forms a closure for the upper portion of the tool. The spherical valve element is therefore retained in the passage 30 and cannot become inadvertently separated from the tool during shipment and storage. It may be removed from the passage 30 when the thread protector is removed for attachment of the tool to the lower section of drill pipe.

With the spherical valve element 48 in place against the seat member 44, downward flow of washing fluid through the drill string is diverted downwardly and outwardly through the venturi ports 36 as shown by the flow arrow and enters the annulus 28 between the inner and outer barrels. The washing fluid continues to flow downwardly and exits downwardly and outwardly through a plurality of velocity jets 50 that are formed in the outer barrel 22.

The well service tool is open from the bottom portion thereof to an object collection chamber 52 that is defined by the inner barrel 24. It is desirable to cause upward flow of fluid into the object collection chamber 52 from the bottom portion of the multiservice tool. In order to accomplish such flow, it is necessary that the fluid be allowed to flow from the chamber 52 outwardly to the annulus defined between the outer barrel 22 and the well bore or casing surrounding the tool. A plurality of annulus ports 54 are formed through the inner barrel 22, the outer barrel 24 and the centralizer elements 26, thus completing the liquid circuit for flow reversal. The downward flow of washing fluid is diverted outwardly into the annulus 28 by the inclined apertures of the velocity sleeve and flows outwardly into the well bore from the velocity jets 50. The downwardly and outwardly oriented jets of washing fluid create turbulence at the bottom of the well bore and, since the velocity jets 50 are oriented in evenly spaced manner about the periphery of the outer barrel 22, the turbulent flow at the bottom of the well bore is caused to enter the bottom of the well service tool and flow upwardly into the object collection chamber 52. Any objects at the lower portion of the well bore will be caused to become entrained in the washing fluid and transported upwardly into the object collection chamber 52.

With regard to the velocity-induced, directionally-reversed jetting action that causes fluid transportation of the objects into the object collection chamber, the following fluid velocities were found to occur. These velocities were based on a pumping rate of 200 gallons per minute. The washing fluid velocity is changed within the well service tool during redirection or reversal that occurs as the spherical valve element 48 becomes seated against the valve seat 44. As the fluid enters the passage 16 in absence of the spherical valve element, the flow velocity thereof is 25 feet per second. The spherical valve element is then pumped downwardly through the drill string until it is seated against the valve seat 44. The washing or drilling fluid at this time is redirected through the venturi ports 36 where it becomes accellerated to a velocity of 43 feet per second. The flow of the fluid continues down through the annulus 28 between the inner and outer barrels until it exits from the velocity jets 50 in downwardly and outwardly directed manner. The velocity of the fluid exiting the velocity jets is 22 feet per second. By means of deflection from the sides and bottom of the hole, the fluid is forced at a velocity of 2.3 feet per second upwardly through the core shoe opening and into the object collection chamber 52. This velocity jetting activity is sufficient to force junk objects upwardly from the bottom of the hole, entrain the objects in the flowing fluid and transport the objects into the object collection chamber. As the fluid moves upwardly through the object collection, it is redirected by the annulus ports 54 outwardly and upwardly toward the wall or casing of the well, causing the fluid to flow upwardly through the annulus between the drill pipe and casing to the surface where it is prepared for recirculation.

It is desirable to ensure that objects such as rock bit cones, tail chains, hammer heads, slips, bearings, junk mill debris and the like are positively retained within the object collection chamber. This feature is ensured in accordance with the present invention by providing both magnetic and mechanical apparatus for retention of the objects. Moreover, the mechanical apparatus is adapted to function in conjunction with a core shoe, thus enabling the core shoe to ream over the object at the bottom of the well bore, thus developing a structural core from the formation which serves also as a seal plug or retainer to assist in retaining the junk within the chamber 52. To accomplish these purposes, the outer barrel 22 is formed to define an externally threaded lower extremity 56 that is adapted to receive the internally threaded upper extremity 58 of a combination core shoe and object catcher section 60. The internal threaded portion 58 of the lower section 60 of the tool is of substantially identical character as compared to the internal thread 20 at the upper portion of the outer barrel. This enables the outer barrel to be removed from the connector sub 12 and allows the lower section 60 to be directly connected to the connection sub in the manner illustrated in FIG. 8 and described hereinbelow.

Figure 8:
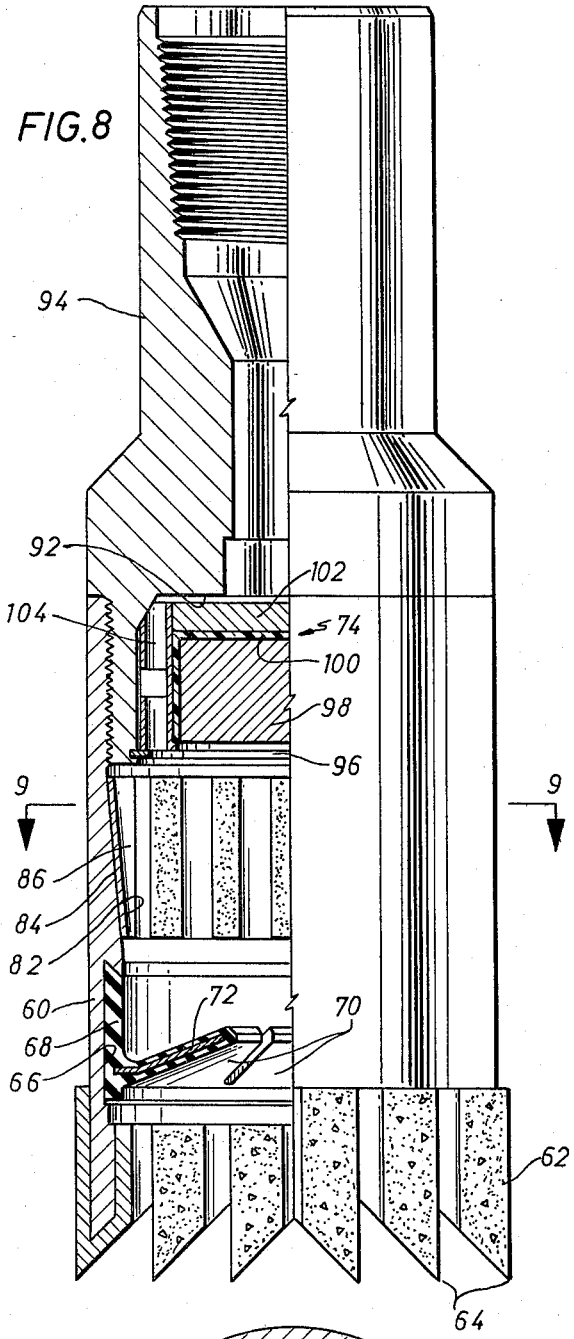
FIG. 8 is a sectional view of an alternative well service tool which is capable of being made up of only the upper and lower portions of the well service tool of FIG. 1, and illustrating the flexibility of design that is supported by the well service tool.

At the lower portion of the lower section 60 there is provided a core shoe 62 having the usual core reamer teeth 64 defined at the lower extremity thereof. The core shoe is of tubular form, and the reamer teeth 64 are formed of tungsten carbide or some other suitable wear-resistant material. The tungsten carbide material gives the hardness needed in milling hard formations such as quartz deposits. The core shoe may be of standard size or oversized as required when the hole or casing is of larger dimension as compared to the outer diameter of the tool. With the tool made up as shown in FIGS. 1 and 8, rotation of the tool 10 by the drill string will cause the core shoe to ream an annular bore through the formation, thereby causing a core to be formed. During such reaming, the tool moves downwardly over the core, thus causing the core to enter the object collection chamber 52. Within the lower section 60 of the tool is defined an annular receptacle 66 within which is received an annular body 68 such as is formed by rubber or any other suitable similar resilient material. To the annular rubber body 68 is integrally connected a plurality of object retention fingers 70 that extend transversely across the lower portion of the object collection chamber. The finger elements 70 are each reinforced with a metal reinforcement such as shown at 72 thereby providing the fingers 70 with a designed degree of structural integrity. The fingers 70 are sufficiently flexible in the upward direction that they will yield quite readily and allow an object to pass into the object collection chamber 52. Fingers 70, however, are sufficiently rigid when downward force is applied thereto that they effectively withstand substantial downward force and thereby function effectively to prevent typical well junk from falling back to the bottom of the hole. The flexible fingers 72 are also sufficiently yieldable to allow cores cut by the core shoe 62 to move upwardly relative to the fingers as the reamer teeth 64 cut through the formation. The resilient fingers 70 therefore define mechanical means for retaining objects within the object collection chamber 52.

Within the object collection chamber is provided a magnet element 74 which is able to move linearly within the object collection chamber 52 and with the lowermost extent of its downward travel within the inner barrel being the position shown in FIG. 1, where the floating magnet 74 engages an annular retainer element 76 such as a conventional snap ring that is appropriately received within an annular groove defined within the outer barrel 22 just below the lower extremity of the inner barrel 24. The uppermost position of the floating magnet 74 within the object collection chamber is with an edge portion 78 thereof in engagement with the lower portion of a tapered or frusto-conical surface 80 defined at the upper portion of the inner barrel. When objects such as junk, formation cores, etc. move into the object collection chamber 52, these objects may urge the floating magnet 74 upwardly to the extent of its travel, thereby allowing the object to be of quite lengthy nature, i.e. as in the case of formation core samples, which, for practical purposes, may be in the order of two feet or more in length. Any ferrous metal objects that enter the object collection chamber will be attracted by the floating magnet 74 and will be retained in the object collection chamber by the magnetic attraction thereof.

Figure 5:
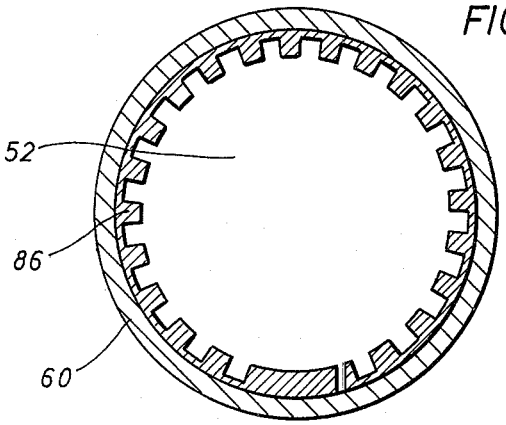
FIG. 5 is a transverse sectional view taken along line 5—5 of FIG. 1 and illustrating the core catcher portion of the well service tool in detail.
Figure 6:
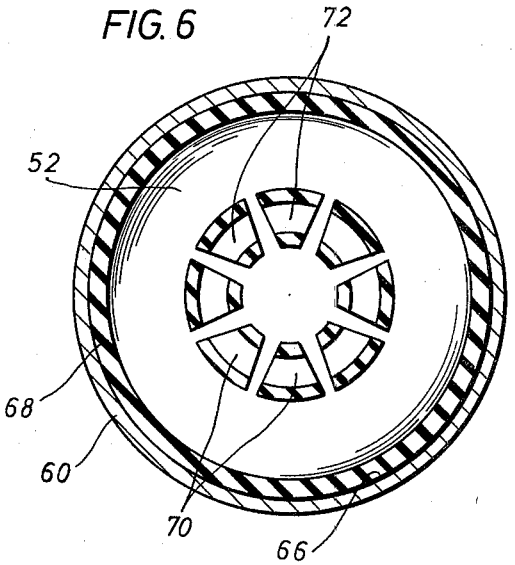
FIG. 6 is a transverse sectional view taken along line 6—6 of FIG. 1 and illustrating the integral junk object catcher in detail.
Figure 7:
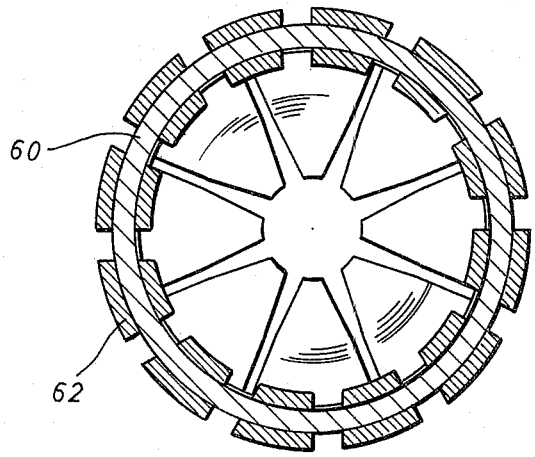
FIG. 7 is a transverse sectional view taken along line 7—7 of FIG. 1 and illustrating the core shoe structure of the well service tool.
Figure 9:
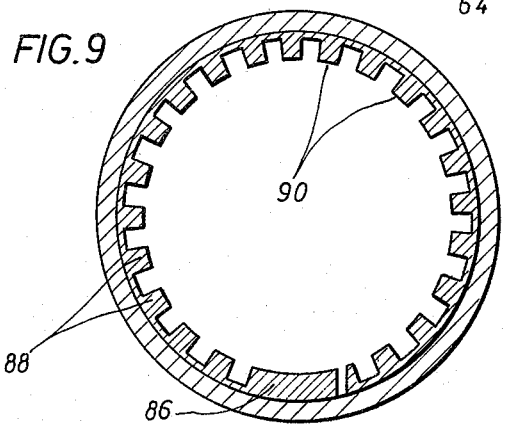
FIG. 9 is a transverse sectional view taken along line 9—9 of FIG. 8 and showing the cam energized core catcher device thereof in detail.

It is desirable to ensure that sample cores entering the object collection chamber are broken away from the formation and positively retained within the chamber 52 for extraction from the well bore. As shown in FIG. 5, and in more detail in FIGS. 8 and 9, the lower section 60 is formed to define an internal tapered or frusto-conical surface 82 that is engaged by a tapered outer surface portion 84 of an annular core catcher ring 86, which, as shown in FIG. 9, is in the form of a split ring. The split ring 86 is formed internally to define a plurality of ribs or ridges 88 defining outer surface portions 90 that are capable of engaging the core that is cut by the core shoe 62. As the core moves upwardly within the object collection chamber 52 by virtue of downward movement of the tool during core reaming, the core catcher 86 is moved upwardly relative to the tapered surface 82 thereby allowing the core to pass readily into the object collection chamber. After the core drilling operation has continued sufficiently to fill the object collection chamber with the core, the tool 10 is then moved upwardly by the drill string and this upward movement, by virtue of the close fitting relation that is established between the core and the split ring core catcher element 86, causes the split ring to move downwardly along with the core. This downward movement of the split ring 86 causes a camming action to occur between the tapered surface 82 and the tapered outer surface 84 of the split ring. This camming action forces the surfaces 90 into even tighter gripping engagement with the cylindrical surface of the core. The gripping relationship that is established between the surfaces 90 and the core is sufficient to cause separation of the core from the formation when the tool is moved upwardly by the drill string. The tool, with the core inside, may simply be transported to the surface and the core extracted in typical manner. The split ring element 86 functions as a collet to tightly grip and retain the core during separation of the core from the formation and during transportation of the core upwardly to the surface. The split ring collet, however, does not interfere with movement of the core into the object collection chamber 52 by virtue of the cooperating tapered surfaces 82 and 84.

With reference now particularly to FIG. 8, the magnet element 74 is shown to be retained within an annular receptacle 92 defined within a connection sub 94. In this case, a retainer ring element 96 will be received within a retainer ring groove formed at the lower portion of the connector sub and will provide suitable support for the magnet element. The magnet is shown at 98 and includes a nonmetallic backing structure 100 that separates the magnet from a welded plate 102. A plurality of flow passages 104 are defined about the peripheral portion of the magnet structure, thereby allowing flow of washing fluid downwardly past the magnet and through the tool during conventional washing and reaming operations. The flexible fingers 70 and the annular rubber body structure 68 are essentially constructed and function as described above in connection with FIG. 1.

MULTIPURPOSE OPERATION

When the multipurpose well tool is to be employed for service operations such as removal of junk, cutting of formation cores, etc., the thread protector is removed and the spherical valve element is removed from passage 16. The tool is then connected to the lower extremity of a drill string and is lowered into the well bore. Normal circulation of washing or drilling fluid will occur in absence of the spherical valve element when the fluid is pumped downwardly through the drill string and through the multipurpose well service tool where it exits through the opening defined by the core shoe at the bottom of the well tool. Reverse circulation is attained through the unique barrel construction when the spherical valve element is pumped downwardly through the drill string and becomes seated against the valve seat. Circulation of fluid is directed through the velocity sleeve, whereat the velocity is increased, and through the inner passages of the barrel. The circulation fluid is then jetted out with increased velocity through the velocity jets and is directed outwardly and downwardly around the full annulus of the well bore. The circulation fluid flows in a continuous stream into the barrel and thence outwardly through the annulus ports which are located intermediate the length of the barrel structure. When the well service tool or barrel is approximately ten feet from the bottom of the well bore, the circulation pumps are energized to force circulation of fluid through the barrel for a few minutes in order to flush out any mud that may have been introduced into the barrel during run in. The spherical valve element is then inserted into the drill string and is pumped downwardly to the well service tool. The downward progress of the spherical valve element will continue until it reaches the valve seat. When circulation of the washing or drilling fluid is resumed, the drill string is rotated slowly to the right during lowering of the barrel to the bottom of the hole. The fluid is forced downwardly through the inner passages of the barrel and with increased velocity is jetted outwardly and downwardly against the flow annulus of the well bore or casing where it flushes all objects into the object collection chamber defined by the long hollow barrel structure. Fluid returns to the annulus through annulus ports located intermediate the extremities of the barrel, which allows for a reverse circulation action.

Recovery of fish and core is accomplished while maintaining fluid circulation, by rotating the well service tool to the bottom of the well bore. Rotation of the drill string and tool is continued to the right while the well service tool is lowered, enabling the core shoe to cut a length of core that will enable the fish to be forced past the integral core catcher structure. Although there is no restriction on the length of the well service tool, an appropriate length for accomplishing the intended fishing and core recovery operations includes a barrel structure sufficient to accept a sample core in the order of 24 inches in length. The flexible rubber fingers on the integral core catcher structure fold upwardly while the core and fish are entering the object collection chamber. All metallic material at this point is attracted by the permanent magnet. The magnet telescopes within the inner barrel structure and has a magnetic attraction in the order of 300–500 lbs. and a magnet contact area of 17.0 square inches. It has been determined that optimum core reaming operations will occur if approximately one ton of weight is maintained on the core shoe during rotation of the barrel in the order of 100–120 revolutions per minute. Rotation of the drill string and well service tool is then ceased and circulation of washing or drilling fluid is also ceased when an appropriate core length has been milled by the core shoe. The drill string is then simply lifted in order to separate the core from the formation and withdraw the core, along with the junk objects from the bottom of the well bore. In unconsolidated formations where a solid core cannot be cut, all junk is retained by the magnet and integral catcher structure.

The multipurpose well service tool of this invention requires no hand tools for operation and can be made up or broken down with normal cat-head tongs or hand tongs, which are readily available on all land rigs and off-shore rigs, foreign or domestic. The velocity sleeve can be replaced in order to adjust the velocity of the circulating, directionally-reversed fluid simply by inserting a long object such as a pry-bar handle into the breakout holes 42 and unthreading the velocity sleeve from its connection with the inner barrel structure. The core catcher structure may be replaced simply by unscrewing the core shoe from the outer barrel. The integral catcher structure is also designed so that when the catcher makes contact with the bottom of the well bore, the two configurations are matching. The invention is equipped with universal threads in order to accommodate elimination of the intermediate barrel section and running of the core shoe in direct connection with the connection sub. This feature is advantageous when fishing operations are conducted for rock bit cones, still incorporating an integral catcher structure and a magnet for magnetic attraction of the cones.

During conventional washing operations, the spherical valve element 48 will not be emplaced against the annular seat element 40 and washing fluid will continue downwardly from the drill string through the velocity sleeve 30 into the object collection chamber 52 of the inner barrel and downwardly out the opening defined by the core shoe. Only a small amount of fluid will flow downwardly and outwardly through the velocity jets and normal washing operations may be continued. In the event it is desired to cut a formation sample core, the tool 10 is simply rotated by the drill string causing the reamer teeth 64 to ream the formation and develop a core. The core is received within the object collection chamber 52 and is capable of moving the magnet element 74 upwardly to shoulder out against shoulder 80 defined within the inner barrel. The core is broken off by the core catcher structure 86 in the manner indicated above, and is then transported to the surface for inspection.

In the event the tool of FIG. 1 is intended to be utilized for velocity induced removal of junk from the bottom of the well bore, the spherical valve element 48 is pumped downwardly through the drill string to the valve seat 44 and thereafter flow of the washing fluid is diverted downwardly and outwardly from the velocity jets 50. This accomplishes flow reversal at the bottom of the well. The directionally reversed flow of washing fluid causes objects at the bottom of the hole to be washed upwardly into the object collection chamber past the integral catcher structure defined by the flexible finger elements 70. The junk objects are therefore retained by the fingers 70 during transportation of the objects to the surface for extraction from the well. If the objects are of ferrous nature, they may be further retained by the magnetic attraction activity of the floating magnet 74.

In many cases, the core reaming activity of the tool may be employed to enhance removal of objects from the well bore. Especially where bearings or other small objects are involved, they may be of sufficiently small and dense nature that washing of the objects into the object collection chamber is difficult to accomplish. In this case, the tool may be rotated by the drill string, causing the core shoe 62 to ream a core about the objects at the bottom of the well bore. The core then forces the objects upwardly into the object collection chamber 52 at the upper extremity of the core and, when the core is broken off and transported to the surface by the core retainer structure 86, the junk object logically is retained within the chamber 52 and is extracted from the well bore along with the core.

In view of the foregoing, it is apparent that the present invention is one well adapted to attain all of the objects and features hereinabove set forth, together with other features which are inherent from the description set forth hereinabove.

In view of the foregoing, it is respectfully submitted that the present invention is clearly capable of achieving each of the objects and features hereinabove set forth together with other objects and features that are inherent in the structure of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof. It is to be understood that all matters hereinabove set forth or shown in the accompanying drawings are to be interpreted as illustrative and not in any limiting sense.

What is claimed is:

1. A multipurpose fluid flow assisted downhole tool for removing metal objects and formation core samples from the bottom of wells, said downhole tool comprising:

a tubular connection sub for connecting said tool to a pipe string to be extended into a well bore:

elongated tubular housing means being secured to said connection means and defining an internal object receiving chamber, said housing means further defining fluid flow means allowing circulation of fluid from said pipe string through said connection sub and through at least a portion of said housing means, said housing means including an outer barrel being connected at the upper extremity thereof to said tubular connection sub, said outer barrel defining velocity jet means, an inner barrel being fixedly disposed within said outer barrel, said inner barrel defining an internal chamber and cooperating with said outer barrel to define first fluid passage means between said inner and outer barrels, said first fluid passage means being in communication with said velocity jet means, and means for selectively directing fluid flowing through said tubular connection sub to said fluid passage means and for selectively directing fluid flowing through said tubular connection to said internal chamber;

an object receptacle being provided at the lower extremity of said housing means and defining an object receiving opening;

a plurality of flexible radial fingers being connected to the interior of said object receptacle and extending transversely toward the center of said object receptacle and being positioned in upwardly inclined relation, said radial fingers being sufficiently flexible in the upward direction to allow passage of an object past said fingers into said object receptacle and being sufficiently rigid in the downward direction to prevent objects from falling out of said object receptacle.

2. A multipurpose fluid flow assisted downhole tool as recited in claim 1, wherein:

an annular body of resilient material is retained within said object receptacle; and said flexible radial fingers are formed integrally with said annular body, with the free extremities thereof positioned to define a central opening.

3. A multipurpose fluid flow assisted downhole tool as recited in claim 2, wherein:

said flexible fingers are each reinforced by means of metal reinforcing members to control the flexibility of said fingers.

4. A multipurpose fluid flow assisted downhole tool as recited in claim 1, wherein said tool includes:

a core shoe defining the lower extremity of said tool and adapted to cut sample cores from the formation being drilled upon rotation of said tool; and core sample retainer means is disposed within said housing means and is adapted to establish peripheral engagement with a core sample and retain said core sample within said object receptacle.

5. A multipurpose fluid flow assisted downhole tool as recited in claim 4, wherein:

said core sample retainer is located within said housing means above said flexible radial fingers.

6. A multipurpose fluid flow assisted downhole tool as recited in claim 4, wherein said core sample retainer means comprises:

downwardly and inwardly inclined cam surface means being defined within said housing means; and an annular collet element being capable of radial contraction and expansion, said collet element defining mating cam surface means cooperating with said cam surface means of said housing means to cause radial contraction of said collet element upon downward movement of said collet element within said housing means.

7. A multipurpose fluid flow assisted downhole tool as recited in claim 6, wherein:

said collet element is in the form of a split ring and defines a plurality of ridges and grooves that cooperate with a core sample positioned therein to define a plurality of fluid passages allowing fluid flow past the core sample.

8. A multipurpose fluid flow assisted downhole tool as recited in claim 1, wherein:

magnet means is positioned within said housing means, said magnet means attracting and retaining any ferrous metal objects that are transported into said object receptacle by flowing fluid.

9. A multipurpose fluid flow assisted downhole tool as recited in claim 1, wherein:

said velocity jet means directs at least one jet of fluid downwardly and outwardly from said outer barrel; and said inner and outer barrels cooperate to define reversing fluid passage means above said velocity jet means allowing flow of fluid from said internal chamber through said inner and outer barrels.

10. A multipurpose fluid flow assisted downhole tool as recited in claim 9, wherein:

said reversing fluid passage means is defined by at least one fluid passage oriented in upwardly and outwardly inclined relation to the vertical axis of said housing means.

11. A multipurpose fluid flow assisted downhole tool as recited in claim 1, wherein said housing means includes:

means defining second fluid passage in said inner barrel communicating said internal chamber with said tubular connection means;

seat means being defined within said inner barrel means about said second fluid passage; and blocking means being selectively positionable against said seat means to block the flow of fluid through said fluid flow passage and divert the flow of fluid to said first fluid passage means.

12. A multipurpose fluid flow assisted downhole tool as recited in claim 11, wherein:

said blocking means is a sphere that is of a size fitting said seat means, said sphere being capable of being pumped through said pipe string and tubular connection sub to said seat means along with downwardly flowing fluid.

13. A multipurpose fluid flow assisted downhole tool as recited in claim 11, wherein:

said second fluid passage means is comprised at least in part by a velocity sleeve interconnecting said tubular connection sub with said inner barrel, said velocity sleeve is formed to define a plurality of passages directing the flow of fluid outwardly toward said outer barrel.

14. A multipurpose fluid flow assisted downhole tool as recited in claim 13, wherein:

said plurality of passages of said velocity sleeve are oriented in inclined manner relative to the vertical axis of said housing means directing the flow of fluid downward and outwardly.

15. A multipurpose fluid flow assisted downhole tool as recited in claim 1, wherein:

said inner and outer barrels are disposed in spaced relation defining an annulus therebetween, said annulus defining at least a part of said first fluid passage means.

16. A multipurpose fluid flow assisted downhole tool as recited in claim 15, wherein:

a plurality of centralizers are positioned within said annulus and interconnect said inner and outer barrels, said reversing fluid passage means extending through said centralizers.

17. A multipurpose fluid flow assisted downhole tool as recited in claim 1, wherein:

magnet means is movably positioned within said internal chamber and is allowed freedom of vertical movement with the confines of said internal chamber, said magnet means being capable of attracting any ferrous metal objects that enter said internal chamber.

18. A multipurpose fluid flow assisted downhole tool as recited in claim 17, wherein:

an annular body of resilient material is retained within said object receptacle; and said flexible radial fingers are formed integrally with said annular body, with the free extremities thereof positioned to define a central opening.

19. A multipurpose fluid flow assisted downhole tool as recited in claim 17, wherein said tool includes:

a core shoe defining the lower extremity of said tool and adapted to cut sample cores from the formation being drilled upon rotation of said tool; and core sample retainer means is disposed within said housing means and is adapted to establish peripheral engagement with a core sample and retain said core sample within said object receptacle.

20. A multipurpose fluid flow assisted downhole tool for removing metal objects and formation core samples from the bottom of wells, said downhole tool comprising:

a tubular connection sub for connecting said tool to a pipe string to be extended into a well bore;

elongated tubular housing means being secured to said connection means and defining an internal object receiving chamber, said housing means further defining fluid flow means allowing circulation of fluid from said pipe string through said connection sub and through at least a portion of said housing means;

an object receptacle being provided at the lower extremity of said housing means and defining an object receiving opening;

a plurality of flexible radial fingers being connected to the interior of said object receptacle and extending transversely toward the center of said object receptacle and being positioned in upwardly inclined relation, said radial fingers being sufficiently flexible in the upward direction to allow passage of an object past said fingers into said object receptacle and being sufficiently rigid in the downward direction to prevent objects from falling out of said object receptacle;

a core shoe defining the lower extremity of said tool and adapted to cut sample cores from the formation being drilled upon rotation of said tool; and core sample retainer means is disposed within said housing means above said flexible radial fingers and adapted to establish peripheral engagement with a core sample and retain said core sample within said object receptacle, said core sample retaining means including downwardly and inwardly inclined cam surface means being defined within said housing means, and an annular collet element being capable of radial contraction and expansion, said collet element defining mating cam surface means cooperating with said cam surface means of said housing means to cause radial contraction of said collet element upon downward movement of said collet element within said housing means.

21. A multipurpose fluid flow assisted downhole tool as recited in claim 20, wherein:

said collet element is in the form of a split ring and defines a plurality of ridges and grooves that cooperate with a core sample positioned therein to define a plurality of fluid passages allowing fluid flow past the core sample.

* * * * *